US006804916B2

(12) United States Patent
Myers

(10) Patent No.: US 6,804,916 B2
(45) Date of Patent: Oct. 19, 2004

(54) WINDOW AND DOOR SEALING SYSTEM AND PROCESS

(76) Inventor: Gary L. Myers, P.O. Box 755, Berryville, AK (US) 72616

( * ) Notice: Subject to any disclaimer, the term of this patent is extended or adjusted under 35 U.S.C. 154(b) by 0 days.

(21) Appl. No.: 10/187,490

(22) Filed: Jul. 2, 2002

(65) Prior Publication Data

US 2004/0003552 A1 Jan. 8, 2004

(51) Int. Cl.[7] ..... E04D 3/38; E06B 3/00; E06B 1/04

(52) U.S. Cl. ..... 52/62; 52/208; 52/213

(58) Field of Search ..... 52/204.1, 204.5, 52/204.53, 208, 211, 212, 213, 61, 62, 58, 59

(56) References Cited

U.S. PATENT DOCUMENTS

| | | | | | |
|---|---|---|---|---|---|
| 176,446 | A | | 4/1876 | Shepard | |
| 1,302,789 | A | | 5/1919 | Griffiths | |
| 1,625,688 | A | * | 4/1927 | Schaeffer | 52/61 |
| 1,636,365 | A | | 7/1927 | Hokanson | |
| 1,705,160 | A | | 3/1929 | Stagg | |
| 1,843,264 | A | | 2/1932 | Bales | |
| 2,043,049 | A | * | 6/1936 | Ludden | 52/62 |
| 2,222,908 | A | | 11/1940 | King | |
| 2,422,010 | A | | 6/1947 | Goff | |
| 2,734,602 | A | * | 2/1956 | Dawson | 52/212 |
| 2,969,616 | A | | 1/1961 | Gustafson | |
| 3,103,710 | A | | 9/1963 | Fredricksen | |
| 3,442,055 | A | * | 5/1969 | Posey | 52/62 |
| 4,341,048 | A | | 7/1982 | Minter | |
| 4,485,600 | A | * | 12/1984 | Olson | 52/62 |
| 5,274,968 | A | | 1/1994 | Pardo | |
| 5,630,297 | A | | 5/1997 | Rutherford | |
| 6,305,130 | B1 | * | 10/2001 | Ackerman, Jr. | 52/58 |
| 6,526,709 | B1 | * | 3/2003 | Jacobsen | 52/211 |
| 2002/0115367 | A1 | * | 8/2002 | Lolley et al. | 442/6 |
| 2003/0110718 | A1 | * | 6/2003 | Boisvert | 52/208 |

* cited by examiner

*Primary Examiner*—Carl D. Friedman
*Assistant Examiner*—Kevin McDermott
(74) *Attorney, Agent, or Firm*—Geoffrey A. Mantooth; Arthur F. Zobal; L. Bruce Terry

(57) ABSTRACT

A system and process for sealing exterior windows and doors of a building. For sealing a window, four slots are formed in the building wall spaced from the window. Four panels of material are obtained each having an elongated planar portion with two spaced apart edges and two flanges extending in opposite direction from the two edges respectively. One of each of the flanges of the panels are located in the four slots respectively and each of the other flanges are located next to the window. The lower ends of the two side panels overlap the laterally extending ends of the two side panels, and the upper panel overlaps the upper extending ends of the two side panels. The invention also is applicable to door frames in which case the lower panel will not be employed.

15 Claims, 10 Drawing Sheets

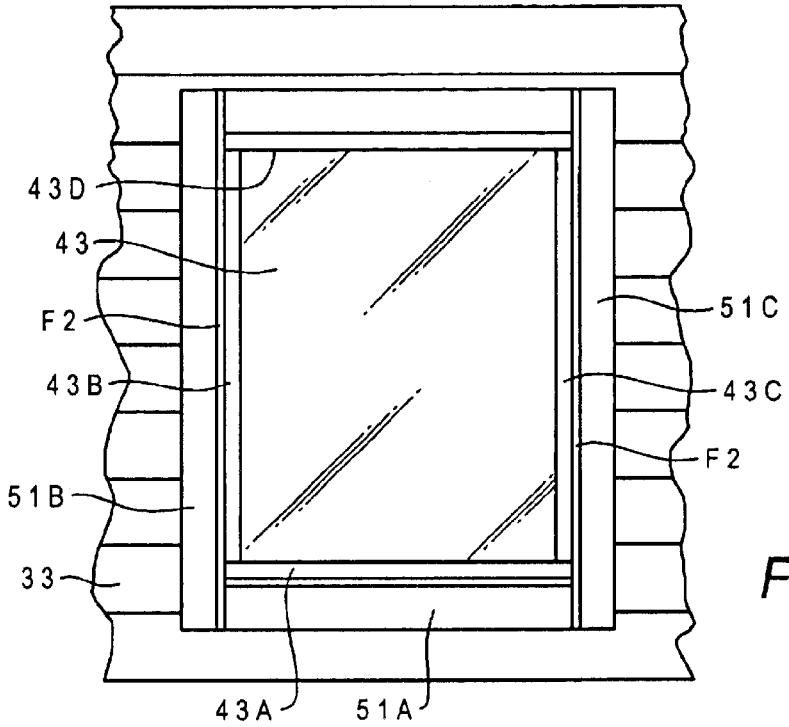
Fig. 16
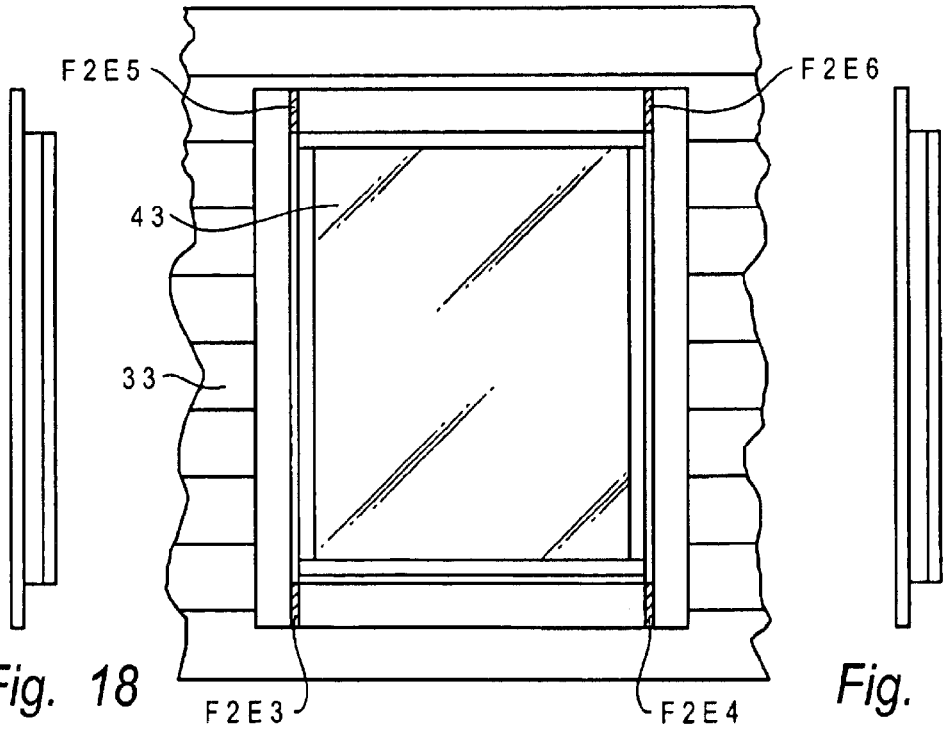
Fig. 18
Fig. 19
Fig. 17

WINDOW AND DOOR SEALING SYSTEM AND PROCESS

BACKGROUND OF THE INVENTION

1. Field of the Invention

The invention relates to a system and process for sealing exterior windows and doors of a house.

2. Description of the Prior Art

In the past, it has been difficult to form a seal between a window and/or door frame of a log house built of rounded wooden logs.

SUMMARY OF THE INVENTION

It is an object to provide a new and unique system and process for sealing the exterior windows and doors which are particularly applicable to buildings constructed of rounded wooden logs.

For sealing a window, a lower, an upper and two side slots are formed in the building wall spaced from the window. Four panels of material are obtained each having an elongated planar portion with two spaced apart edges and two flanges extending in opposite directions from the two edges respectively. One of the flanges of one of the panels is located in the lower slot and its other flange is located next to the lower end of the window. Two of the flanges of two of the panels are located in the two side slots respectively and their other flanges are located next to the two sides of the window. One of the flanges of the fourth panel is located in the upper slot and its other flange is located next to the upper end of the window.

In a further aspect, the lower ends of the two side panels over lap the laterally extending ends of the two side panels, and the upper panel overlaps the upper extending ends of the two side panels.

The invention also is applicable to door frames in which case the lower panel will not be employed.

BRIEF DESCRIPTION OF THE DRAWINGS

FIGS. 16 and 17 illustrate the process of installing two of the panels of FIGS. 6, 7, 10, and 11 to a building and against opposite sides of a window of the building.

FIG. 18 is a view of the panel installed on the left side of the window of FIG. 17 as seen from the left of the exterior of the window.

FIG. 19 is a view of the panel installed on the right side of the window as seen from the right of the exterior of the window.

DESCRIPTION OF THE PREFERRED EMBODIMENTS

Figure 1:
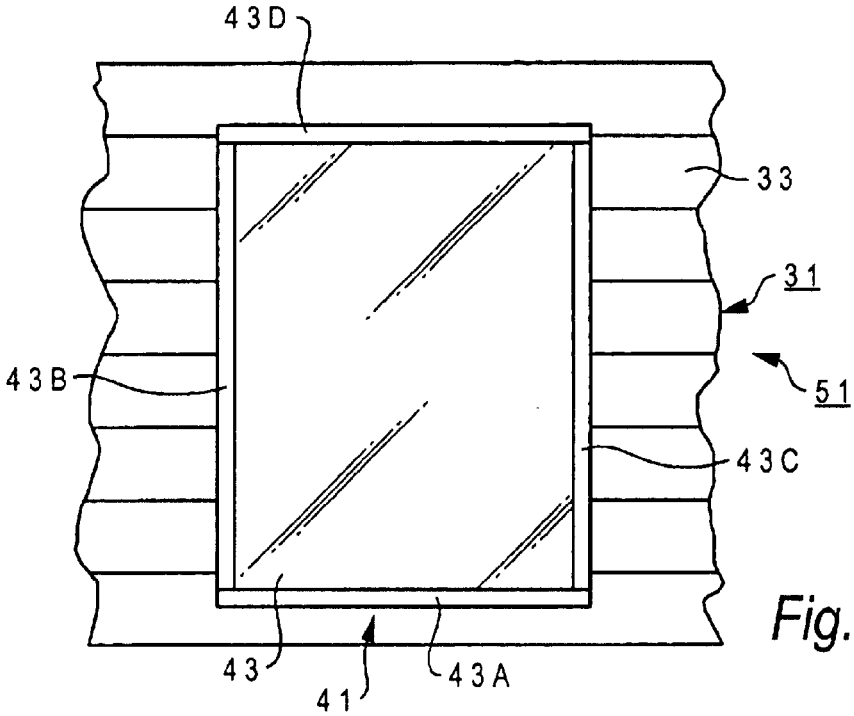
FIG. 1 is an outside view of a window attached to a building having walls formed of rounded logs.
Figure 2:
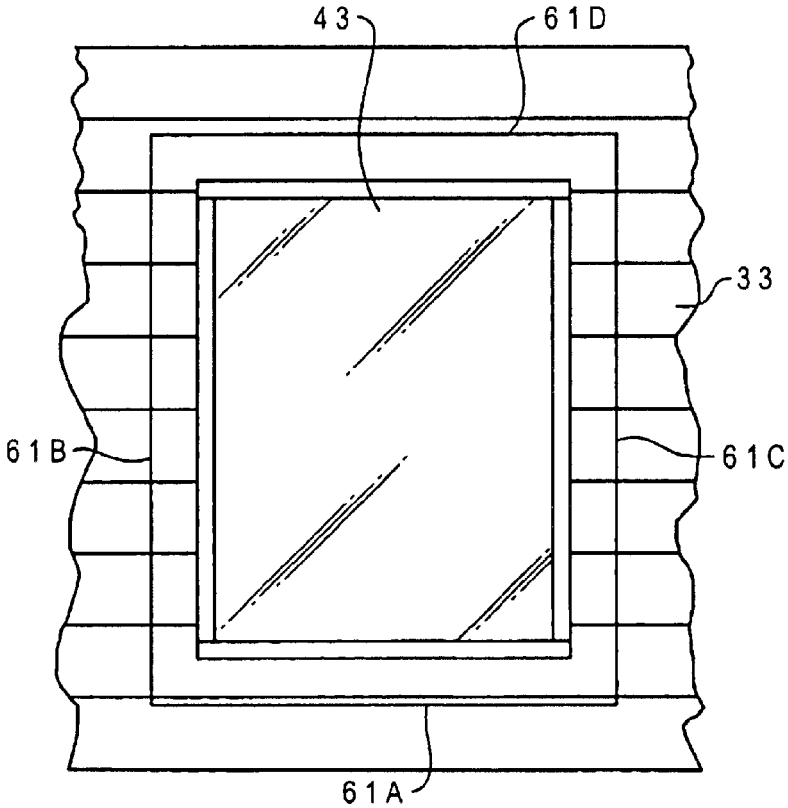
FIG. 2 is a view similar to that of FIG. 1 but with four slots formed in the wall around the window.
Figure 3:
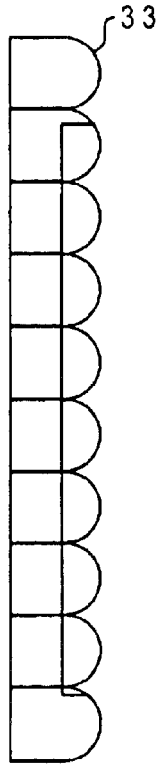
FIG. 3 is a cross-sectional view of the left slot of FIG. 2.
Figure 4:
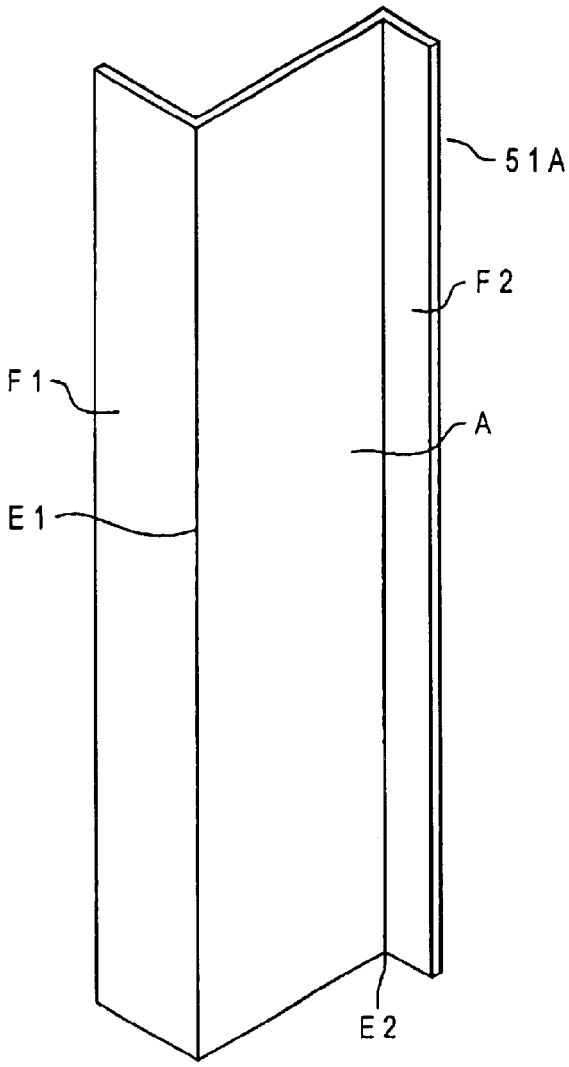
FIG. 4 is an isometric view of one of four panels used in forming a seal around the window of FIG. 1.
Figure 5:
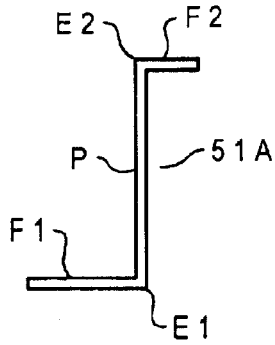
FIGS. 5–8 are end views of four of the panels used in forming a seal around four sides of a window.
Figure 6:
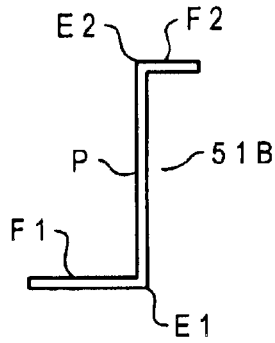
Figure 7:
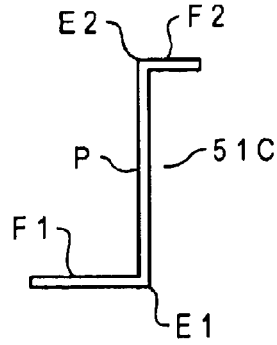
Figure 8:
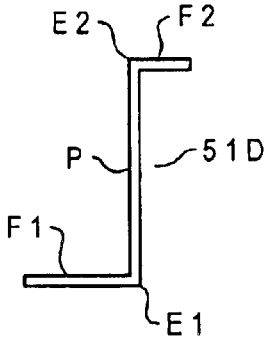
Figure 9:
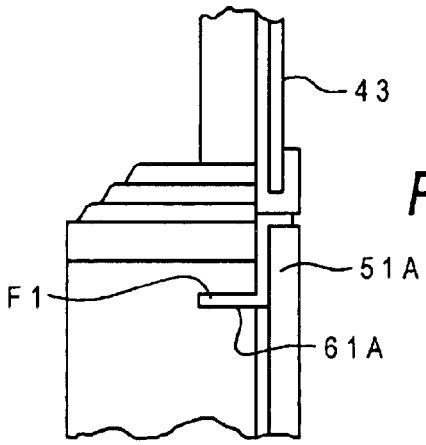
FIGS. 9–12 illustrate the four panels of FIGS. 4–8 installed in the four slots of FIG. 2 around the window.
Figure 11:
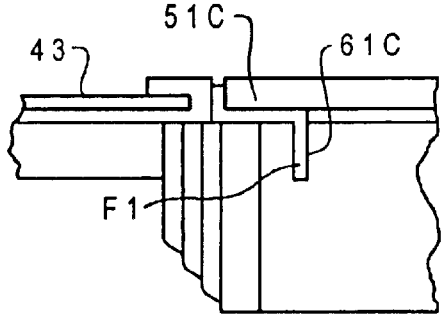
Figure 10:
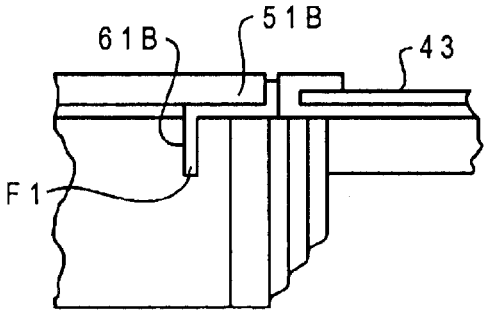
Figure 12:
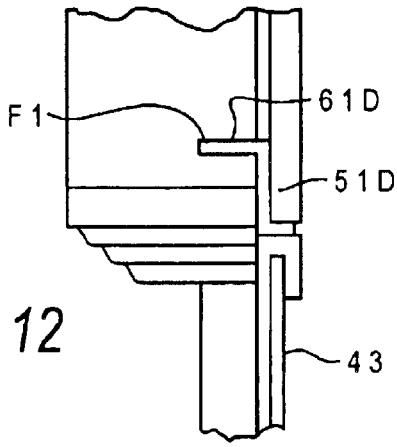
Figure 13:
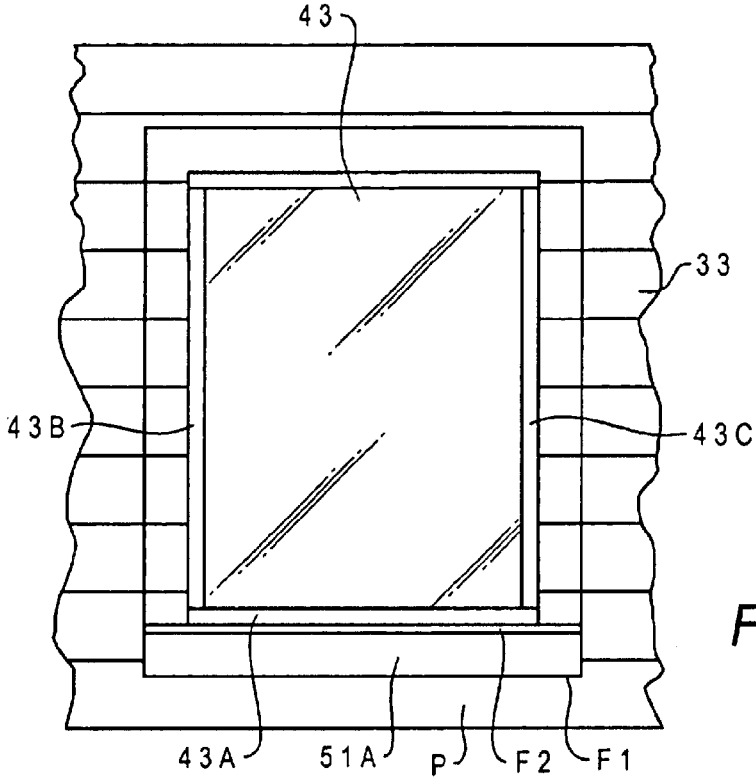
FIGS. 13 and 14 illustrate the process of installing the panel of FIGS. 4, 5, and 9 to a building and against the lower end of a window of the building.
Figure 14:
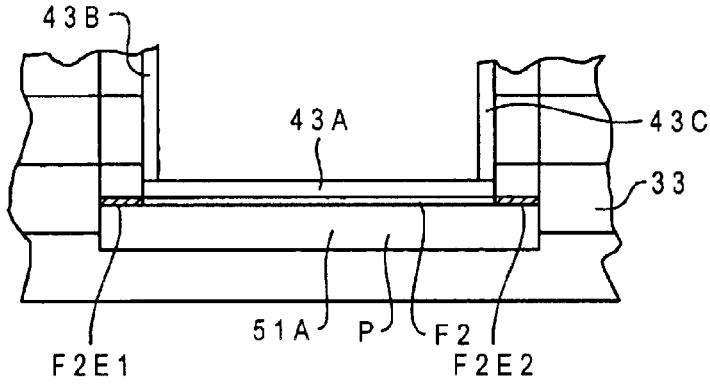

Referring now to FIGS. 1–23 of the drawings, there is illustrated a portion of the exterior side wall 31 of a building which has a window 41 with a glass pane 43 installed to the side wall. The building is of the type having its outer wall formed of logs 33 having rounded outer surfaces as shown more clearly in FIG. 3. The window 41 shown is of the type that cannot be opened and comprises four frame members 43A, 438, 43C, and 43D secured together to hold the glass window pane 43. When installed, the frame members 43A, 435, 43C, and 43D extend outward from the wall 31. In order to form a seal between the wall 31 and all four sides of the window, four panels 51A, 51B, 51C, and 51D of the type shown at 51A are employed. Note also FIGS. 5–12. The panel 51A is an elongated member and comprise an elongated planar portion P with two spaced apart edges E1 and E2 and two flanges F1 and F2 extending in opposite direction from the two edges E1 and E2 respectively. The panels 51A, 51B, 51C, and 51D may be formed of bendable galvanized metal or of a suitable plastic. The flanges F1 and F2 extend the length of each panel with flanges F1 having a width greater than that of flanges F2.

For installing the panels 51A, 51B, 51C, 51D, four slots 61A, 61B, 61C, 61D are cut in the wall 31 laterally outward of each side of the window 41 at a distance slightly less than the width of the panels portion P. Note FIGS. 9–12. The slots 61A, 61B, 61C, 61D each have lengths equal to the length of the panels 51A, 51B, 51C, 51D respectively and depths equal to the widths of the flanges F1. All of the flanges F1 have the same widths and all of the flanges F2 have the same widths.

Figure 15:
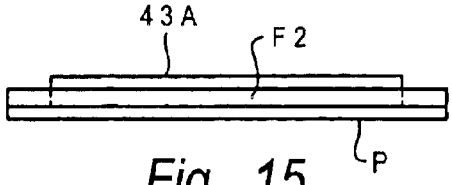
FIG. 15 is a view of the installed panel of FIG. 14 looking upward from below the outside of the window.
Figure 20:
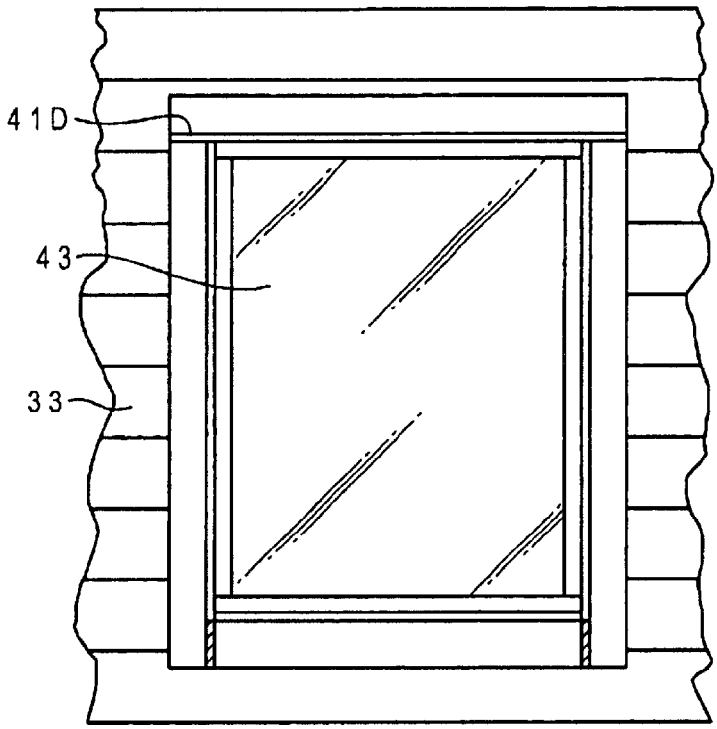
FIGS. 20 and 21 illustrate the process of installing the panel of FIGS. 8 and 12 to a building against the upper end of a window of the building.
Figure 21:
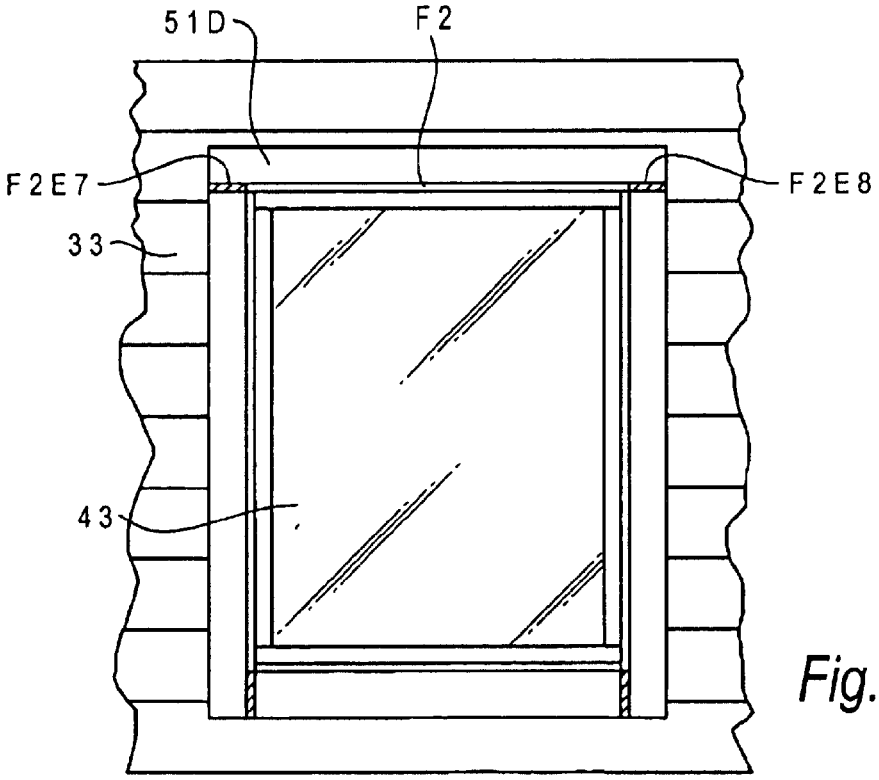
Figure 22:
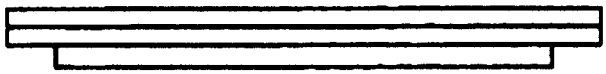
FIG. 22 is a view of the installed upper panel of FIG. 21 as seen looking downward from above the outside of the window.

Referring to FIGS. 9 and 13–15, the panel 51A is installed first. Its flange F1 is installed in the slot 61A with its flange F2 abutting against the underside of the frame 43A. Next, the exposed outer ends of the flange F2 extending laterally beyond the frame members 43B and 43C, as shown in dotted lines in FIG. 15, are cut out such that the remaining portions F2E1 and F2E2 are flush with the planar portion P.

Next, the two side panels 51B and 51C are installed by inserting their flanges F1 into the slots 61B and 61C with their flanges F2 abutting against the window frames 43B and 480 as shown in FIGS. 10, 11, and 16 and 17. The exposed outer ends of their flanges F2 extending below the flanges F2 of the panel 43A are cut out such that the remaining portions F2E3 and F2E4 are flush with the planar portion P of the panels 51B and 51C. The exposed outer ends of the flanges F2 of the panels 51B and 51C extending above the frame 43D also are cut out such that the remaining portions F2E5 and F2E6 are flush with the planar portions P of panels 51B and 51C.

The top panel 51D is installed by inserting its flange F1 in the slot 61D with the flange F2 abutting against the upper side of the frame 43D. The outer ends of the flange F2 extending laterally beyond the flanges F2 of panels 51B and 51C are cut out such that the remaining portions F2E7 and F2E8 are flush with the planar portion P of the panel 51D.

At this point, the four panels may be nailed in place to the logs of the building.

Figure 23:
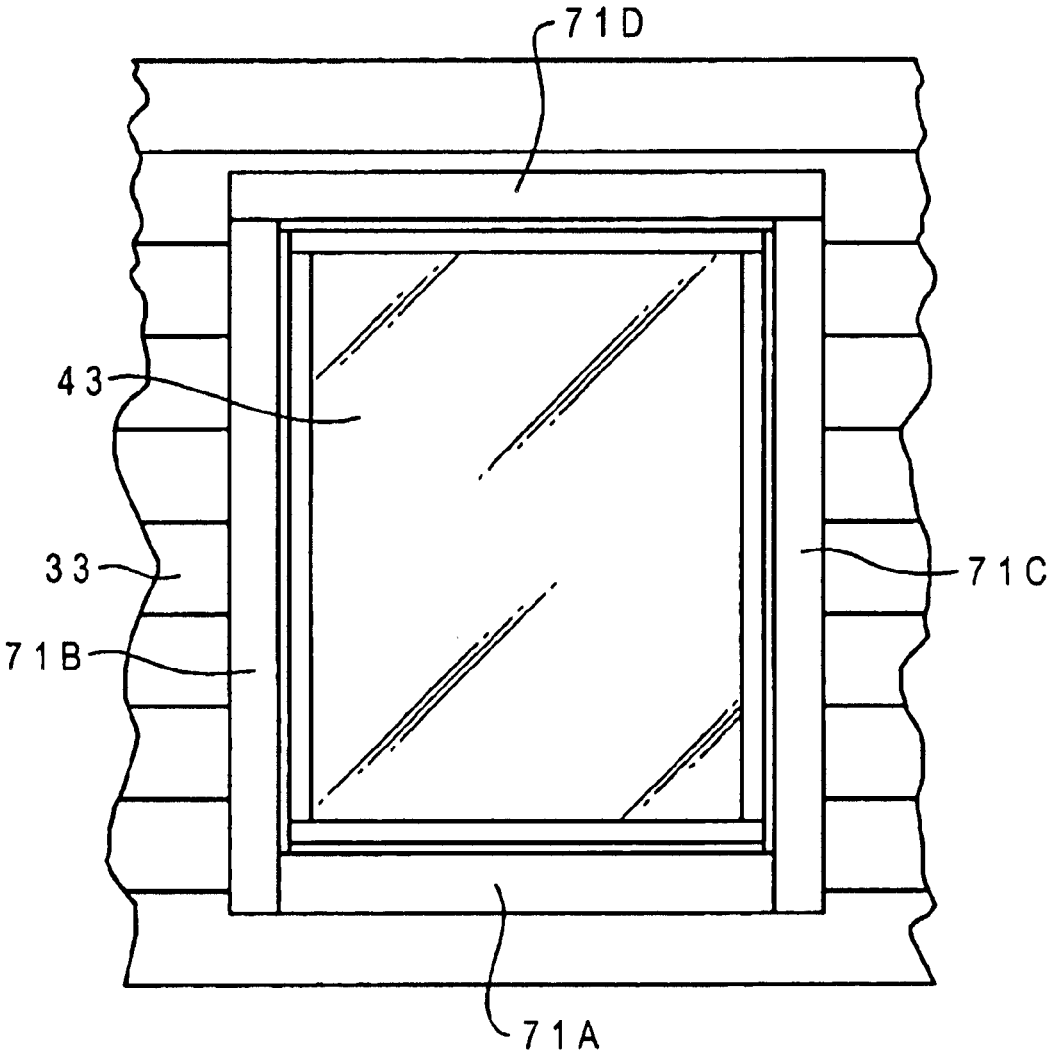
FIG. 23 is a front view of a window of a building with four panels installed to the building against four sides of the window and with wooden trim installed over the vertical side of the panels.
Figure 24:
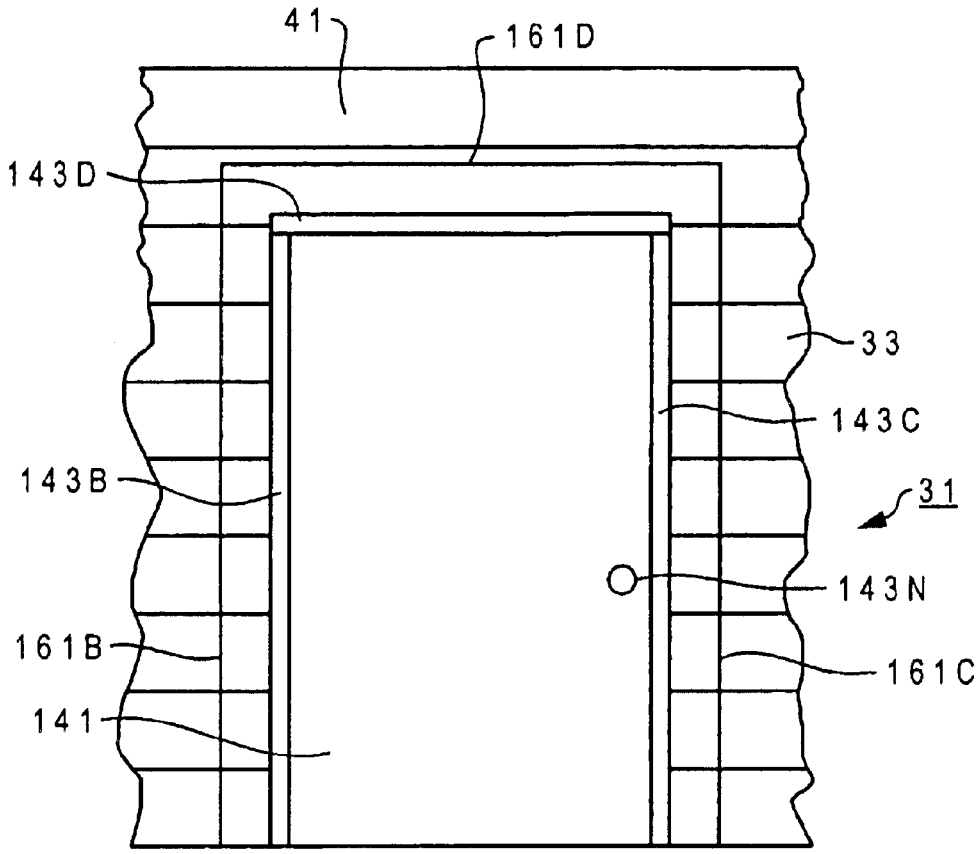
FIG. 24 is an outside view of a door attached to a building having walls formed of rounded logs with three slots formed in the wall around the door.

Wooden trim boards 71A, 71B, 71C and 71D then may be nailed over the panels 51A, 51B, 51C, 51D respectively as shown in FIG. 23.

It is to be understood that the process can be employed to seal windows that open and close and also to form a seal between the wall of a building and the frame of a door. For a door, the lower panel 51A will not be employed.

Referring now to FIGS. 24–28 of the drawings, there is illustrated a portion of the exterior side wall 31 of a building which has a door 141 installed to the side wall. The building is of the type having its outer walls formed of logs 33 having rounded outer surfaces as described previously. The door has hinges (not shown) on the left side and a door knob 143N. Three frame members 143B, 143C, and 143D are secured to the wall around the door 141. When installed, the frame members 143B, 143C, and 143D extend outward from the wall 31. In order to form a seal between the wall 31 and all three sides of the door frame, three panels 51B, 51C, and 51D of the type disclosed previously are employed.

For installing the panels 51B, 51C and 51D, three slots 161B, 161C, and 161D are cut in the wall 31 laterally outward of each side of the door 141 at a distance slightly less than the width of the panels portion P. The slots 161B, 161C, and 161D each have lengths equal to the length of the panels 51B, 51C, and 51D respectively and depths equal to the widths of the flanges F1. All of the flanges F1 have the same widths and all of the flanges F2 have the same widths.

Figure 25:
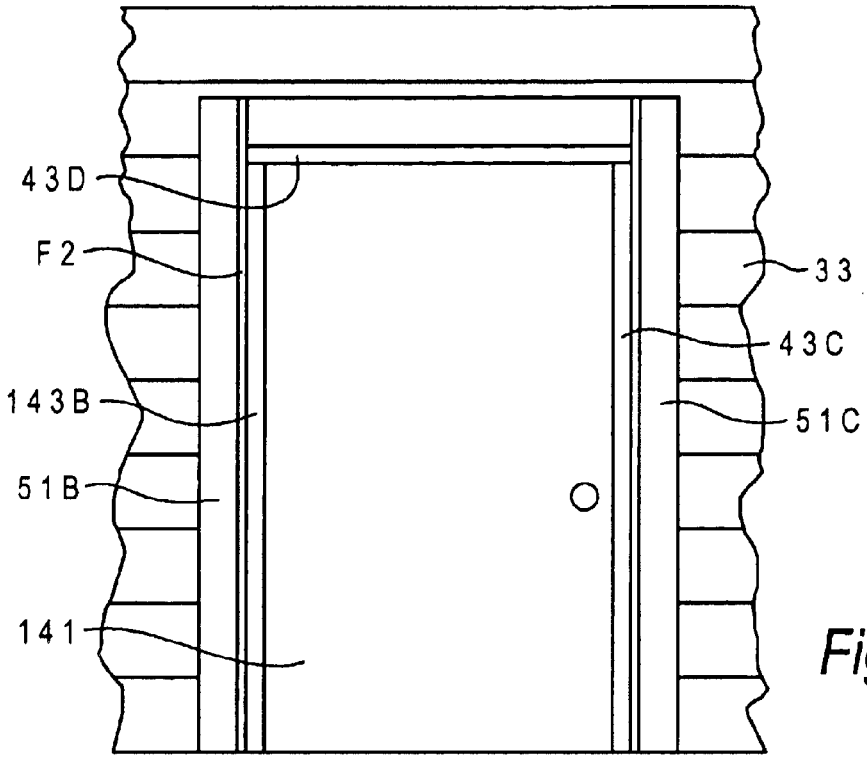
FIGS. 25 and 26 illustrate the process of installing two of the panels of FIGS. 6 and 7 to a building and against opposite sides of a door of the building.
Figure 26:
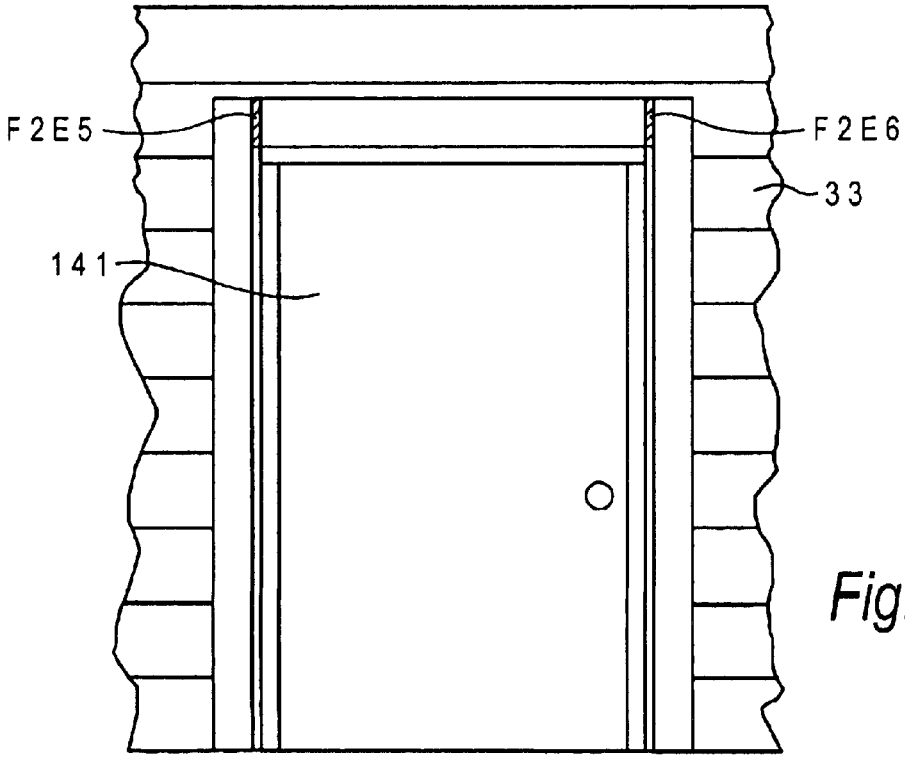
Figure 27:
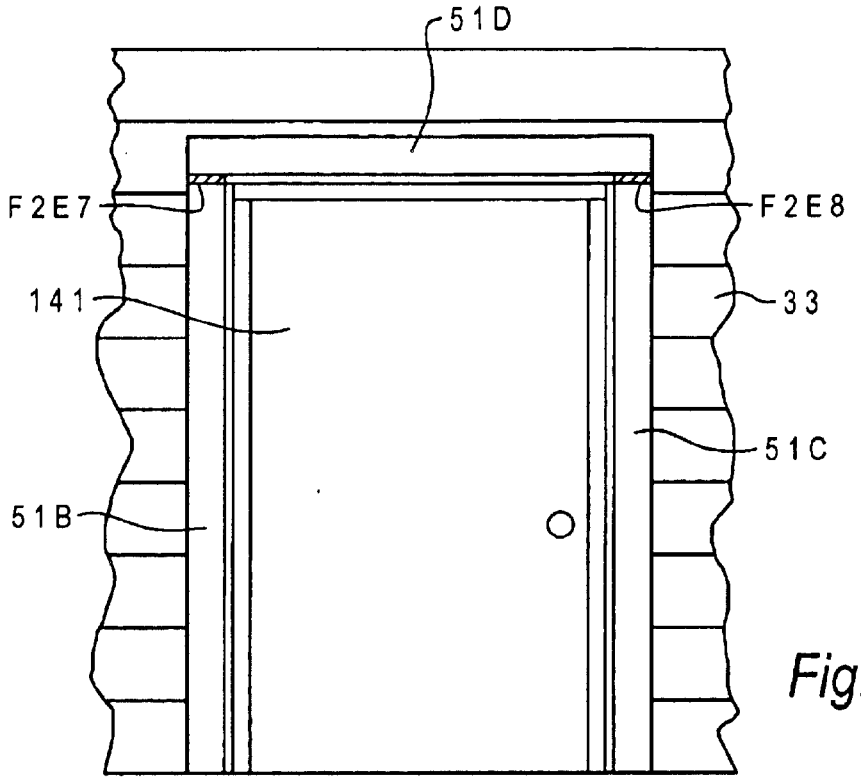
FIG. 27 illustrates the process of installing the panel of FIG. 8 to a building against the upper end of a door of the building.

The two side panels 51B and 51C are installed first by inserting their flanges F1 into the slots 161B and 161C with their flanges F2 abutting against the frames 143B and 143C as shown in FIG. 25. The exposed outer ends of the flanges F2 of the panels 51B and 51C extending above the frame 43D are cutout such that the remaining portions F2E5 and F2E6 are flush with the planar portions P of panels 51B and 51C.

The top panel 51D is installed by inserting its flange F1 in the slot 161D with its flange F2 abutting against the upper side of the frame 143D. The outer ends of the flange F2 extending laterally beyond the flanges F2 of panels 51B and 51C are cut out such that the remaining portions F2E7 and F2E8 are flush with the planar portion P of the panel 51D.

At this point, three panels may be nailed in place to the logs of the building.

Figure 28:
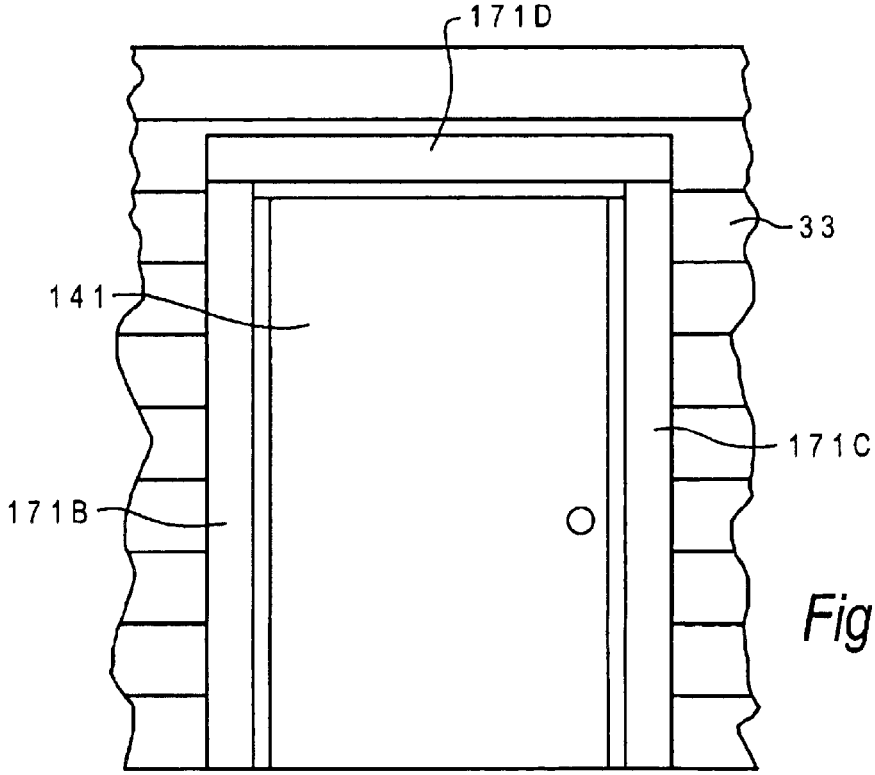
FIG. 28 is a front view of a door of a building with three panels installed to the building adjacent three sides of the door and with wooden trim installed over the vertical sides of the panels.

Wooden trim boards 171B, 171C, and 171D then may be nailed over the panels 51B, 51C, and 51D respectively as shown in FIG. 28.

What is claimed is:

1. A window attached to an, outer side wall of a building, wherein said window has a lower end, an upper end, and first and second sides each of which extends outward from said side wall, comprising:

lower and upper slots formed in said side wall spaced below and above said lower and upper ends of said window respectively, first and second side slots formed in said side wall spaced laterally from said first and second sides of said window respectively, a lower panel of material having a flange located in said lower slot and a flange located next to said lower end of said window with end portions extending laterally beyond said first and second sides of said window, a first side panel of material having a flange located in said first side slot and a flange located next to said first side of said window with a lower portion covering a portion of said lower panel of material extending laterally beyond said first side of said window, a second side panel of material having a flange located in said second side slot and a flange located against said second side of said side window with a lower portion covering a portion of said lower panel of material extending laterally beyond said second side of said window, an upper panel of material having a flange located in said upper slot and a flange located next to said upper end of said window with end portions covering upper portions of said first and second panels of material extending upward beyond said first and second sides of said window.

2. The window of claim 1, wherein:

each of said flanges of each of said panels of material is a single layer of material.

3. The window of claim 1, wherein:

each of said panels of material comprises an elongated planar portion having a given length and width with its said flanges extending in opposite directions at bends which define the width of its said planar portion.

4. The window of claim 3, wherein:

each of said flanges of each of said panels of material is a single layer of material.

5. The window of claim 1, wherein the lower and upper slots formed in said side wall, and the first and second side slots formed in said side wall further include lower end upper slots formed into the thickness of said side wall from the exterior of the wall, and first and second side slots formed into the thickness of said side wall from the exterior of said side wall.

6. A window attached an outer side wall of a building wherein said window has a lower frame, an upper frame, and first and second side frame each of which extend outward from said side wall, lower and upper slots formed in said side wall spaced below and above said lower and upper frames of said window, respectively, first and second side slots formed in said side wall spaced laterally from said first and second side frames of each window respectively, a four panels of material each having an elongated planar portion with two spaced apart edges and two flanges extending in opposite direction from said two edges respectively, one of said panels of material having one of its flanges located in said lower slot and its other flange located next to lower end of said window with end portions extending laterally beyond said first and second side frames of said window, one of said panels of material having one of its flanges located in said first side slot and the other of its flanges located next to said first side frame of said window with a lower portion covering an end portion of said panel of material extending beyond said first side frame of said window and an upper end portion extending upward beyond said upper frame of said window, one of said panels of material having one of its flanges located in said second side slot and the other of its flanges located next to said second side frame of said window with a lower portion covering an end portion of said panel of material extending beyond said second side frame of said window and an upper end portion extending upward beyond said upper frame of said window, one of said panels of material having one of its flanges located in said upper slot and its other flange located next to said upper frame of said window with end portions covering said upper end portions of said panels of material extending upward beyond said upper frame of said window.

7. The window of claim 6, wherein:

each of said flanges of each of said sheets of material is a single layer of material.

8. The window of claim 6, wherein the lower and upper slots formed in said side wall, and the first and second side slots formed in said side wall further include lower and upper slots formed into the thickness of said side wall from the exterior of said side wall, and first and second side slots formed into the thickness of said side wall from the exterior of said side wall.

9. A method of forming a seal around a window attached to an outer side wall of a building wherein said window has a lower end, and upper end, and first and second sides each of which extend outward from said side wall, comprising the steps of:

a forming lower and upper slots in said side wall spaced below and above said lower and upper ends of said window, respectively, forming first and second side slots in said side wall spaced laterally from said first and second sides of said window, respectively, obtaining four panels of material each having art elongated planar portion with two spaced apart edges and two flanges extending in opposite directions from said two edges, respectively, locating one of said flanges of one of said panels of material in said lower slot with its other flange located next to said lower end of said window with end portions extending laterally beyond said first and second sides of said window, locating one of said flanges of one of said panels of material in said first side slot with the other of its flanges located next to said first side of said window with a lower portion covering an end portion of said panel of material extending beyond said first side of said window and an upper end portion extending upward beyond said upper end of said window, locating one of said flanges of one of said panels of material in said second side slot with the other of its flanges located next to said second side of said window with a lower portion covering an end portion of said panel of material extending beyond said second side of said window and an upper end portion extending upward beyond said upper end of said window, locating one of said flanges of one of said panels of material in said upper slot with its other flange located next to said upper end of said window with end portions covering said upper end portions of said panels of material extending upward beyond said upper end of said window.

10. The method of claim 9, wherein the steps of forming lower and upper slots in said side wall, and forming first and second side slots in said side wall further includes the steps of forming lower and upper slots into the thickness of said side wall from the exterior of said side wall, and forming first and second side slots into the thickness of said side wall from the exterior of said side wall.

11. A door attached an outer side wall of a building wherein said window has an upper frame, and first and second side frames each of which extend outward from said side wall, an upper slot formed in said side wall spaced above said upper frame of said door, first and second side slots formed in said side wall spaced laterally from said first and second side frames of said door, three panels of material each having an elongated planar portion with a two spaced apart edges and two flanges extending in opposite directions from said two edges respectively, one of said panels of material having one of its flanges located in said first side slot and the other of its flanges located next to said first side frame of said door, one of said panels of material having one of its flanges located in said second side slot and the other of its flanges located next to said second side frame of said door, one of said panels of material having one of it flanges located in said upper slot and its other flange located next to said upper frame of said door with end portions covering said upper end portions of said panels of material extending upward beyond said upper frame of said door.

12. The door of claim 11, wherein:

each of said flanges of each of said sheets of material is a single layer of material.

13. The door of claim 11, wherein the upper slot formed in said side wall, and the first and second side slots formed in said side wall further include an upper slot formed into the thickness of said side wall from the exterior of said side wall, and first and second side slots formed into the thickness of said side wall from the exterior of said side wall.

14. A method of forming a seal around a door attached to an outer side wall of a building wherein said door has an upper frame and first and second side frames each of which extend outward from said side wall, comprising the steps of:

forming an upper slot in said side wall spaced above and upper frame of said door, forming first and second side slots in said side wall spaced laterally from said first and second side frames of said door, obtaining three panels of material each having an elongated planar portion with two spaced apart edges and two flanges extending in opposite direction from said two edges, respectively, locating one of said flanges of one of said panels of material in said first side slot with the other of its flanges located next to said first side frame of said door with an upper end portion extending upward beyond said upper frame of said door, locating one of said flanges of one of said panels of material in said second side slot with the other of its flanges located next to said second side frame of said door with an upper end portion extending upward beyond said upper frame of said door, locating one of said flanges of one of said panels of material in said upper slot with its other flange located next to said upper frame of said door with end portions covering said upper end portions of said panels of material extending upward beyond said upper frame of said door.

15. The method of claim 14, wherein the steps of forming an upper slot in said side wall, and forming first and second side slots in said side wall further includes the steps of forming lower and upper slots into the thickness of said side wall from the exterior of said side wall, and forming first and second side slots into the thickness of said side wall from the exterior of said side wall.

* * * * *